US007690861B1

(12) United States Patent
Johnson

(10) Patent No.: US 7,690,861 B1
(45) Date of Patent: Apr. 6, 2010

(54) TEMPORARY SLURRY MARKERS

(76) Inventor: Ronald W. Johnson, 11220 Wildwood Dr., Auburn, CA (US) 95603-5762

( * ) Notice: Subject to any disclaimer, the term of this patent is extended or adjusted under 35 U.S.C. 154(b) by 0 days.

(21) Appl. No.: 12/235,381

(22) Filed: Sep. 22, 2008

(51) Int. Cl.
*E01F 9/06* (2006.01)

(52) U.S. Cl. ..... 404/12; 404/16

(58) Field of Classification Search ..... 404/9, 404/12–16; D10/113; 359/531, 532
See application file for complete search history.

(56) References Cited

U.S. PATENT DOCUMENTS 3,901,614 A 8/1975 Overacker
D236,818 S * 9/1975 Stenemann ..... D10/111
4,234,265 A 11/1980 Otis
4,299,874 A 11/1981 Jones et al.
4,445,803 A * 5/1984 Dixon ..... 404/10
4,521,129 A * 6/1985 Krech et al. ..... 404/10
4,991,994 A * 2/1991 Edouart ..... 404/10
5,460,115 A * 10/1995 Speer et al. ..... 116/63 P
5,839,816 A 11/1998 Varga et al.
6,505,994 B1 * 1/2003 Attar ..... 404/16
6,764,249 B2 7/2004 Stone
7,018,131 B2 3/2006 Jordan

OTHER PUBLICATIONS

Traffic Supply, Inc. Eagle Lake, Texas, Temporary Marker Specifications, http://www.elc.net/traffic/tempspec.htm.
Traffic Supply, Inc. Eagle Lake, Texas Temporary Marker Brochure.

* cited by examiner

*Primary Examiner*—Raymond W Addie

(57) ABSTRACT

Disclosed is a temporary pavement marker for pavement surface treatment of existing pavement. The temporary pavement marker may include a base configured to be placed against the existing pavement. An upright section may be connected to the base. The upright section may include a bridge connected between a first upright and a second upright to form a treatment passageway. The bridge, the first upright, the second upright, and the base may be positioned around the treatment passageway.

20 Claims, 6 Drawing Sheets

TEMPORARY SLURRY MARKERS

BACKGROUND

1. Field

The information disclosed in this patent relates to pavement markers utilized during pavement surface treatment.

2. Background Information

Pavement is a durable surface material laid down on an area intended to sustain automobile traffic. Paved roadways and parking lots utilize road surface markings to provide guidance and information to drivers and pedestrians. Striping lines are a typical form of road surface markings. Permanent reflective pavement markers also delineate roadways.

Overtime, asphalt and other pavements mature due to traffic and the weather. For example, continued exposure to the elements may cause pavement surfaces to erode and the oils in the asphalt to oxidize. This oxidation may cause the asphalt to become brittle, at which time it may lose its flexibility and water-sheeting properties.

Slurry sealing is a cost-effective maintenance procedure intended to extend the life of mature asphalt pavements that are still structurally sound. Slurry seal is applied in a viscous, thick, flowing coat over the original roadway surface. This may extend the life of the pavement by protecting it from damaging elements, while at the same time filling in minor irregularities in the pavement surface and improving its appearance with a finished black surface.

After the slurry seal is applied, the finished black surface of the slurry seal covers and hides the existing pavement striping lines. New striping lines then may be added to the new pavement surface. Rather than resurvey the roadway or parking lot to locate positions for the new striping lines, pavement marking companies place temporary markers over the top of the existing traffic lines before applying the slurry seal. The temporary markers provide identifiable physical locations of the existing striping lines. The temporary markers then are used after the slurry seal covers the existing striping lines to locate and add new striping lines over the now covered striping lines. Once the new striping lines are added, the temporary markers may be removed.

Removing the temporary markers is difficult. Often, a large chunk of slurry is pulled up with a temporary marker, leaving a void in the slurry surface that requires repair. To circumvent this, some construction maintenance contracts prohibit the use of temporary markers and require the pavement marking company to resurvey the pavement for striping application. Surveying is an expensive process that either raises the bid of the pavement marking company or reduces the amount of profit made by the pavement marking company. What is needed is an apparatus and process to address these and other issues.

SUMMARY

Disclosed is a temporary pavement marker for pavement surface treatment of existing pavement. The temporary pavement marker may include a base configured to be placed against the existing pavement. An upright section may be connected to the base. The upright section may include a bridge connected between a first upright and a second upright to form a treatment passageway. The bridge, the first upright, the second upright, and the base may be positioned around the treatment passageway.

DETAILED DESCRIPTION

Figure 1:
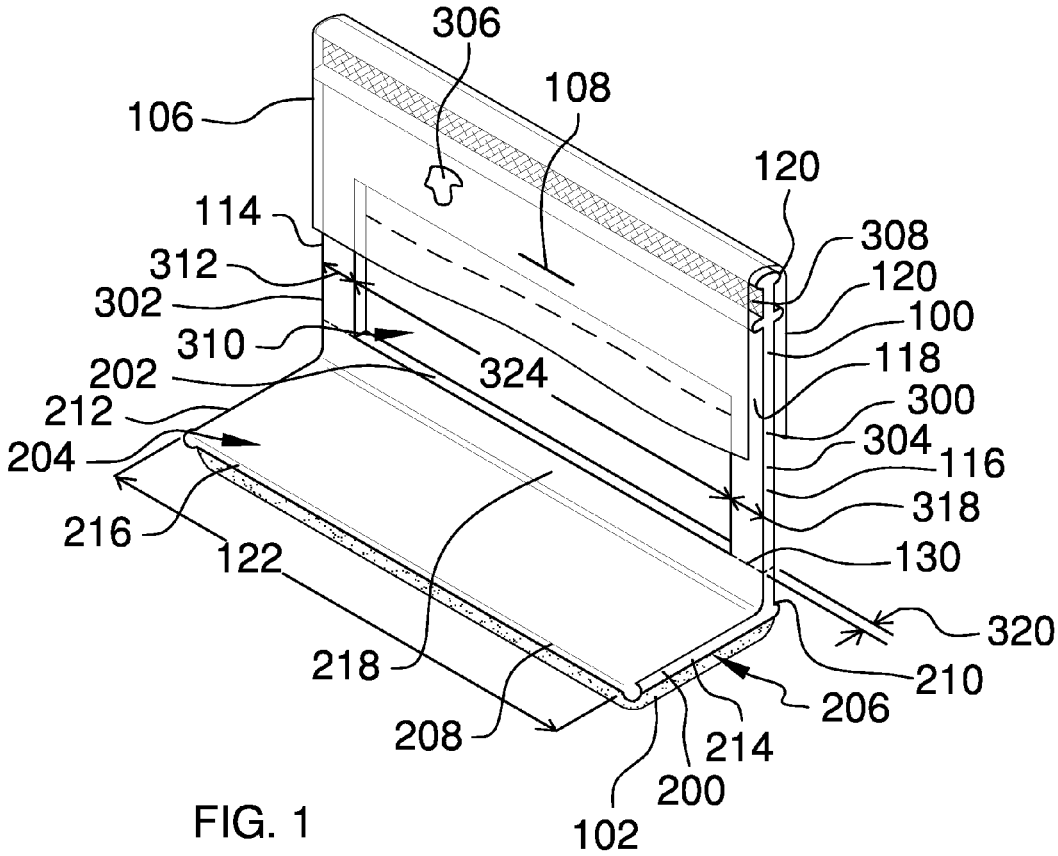
FIG. 1 is an isometric view of marker 100.
Figure 2:
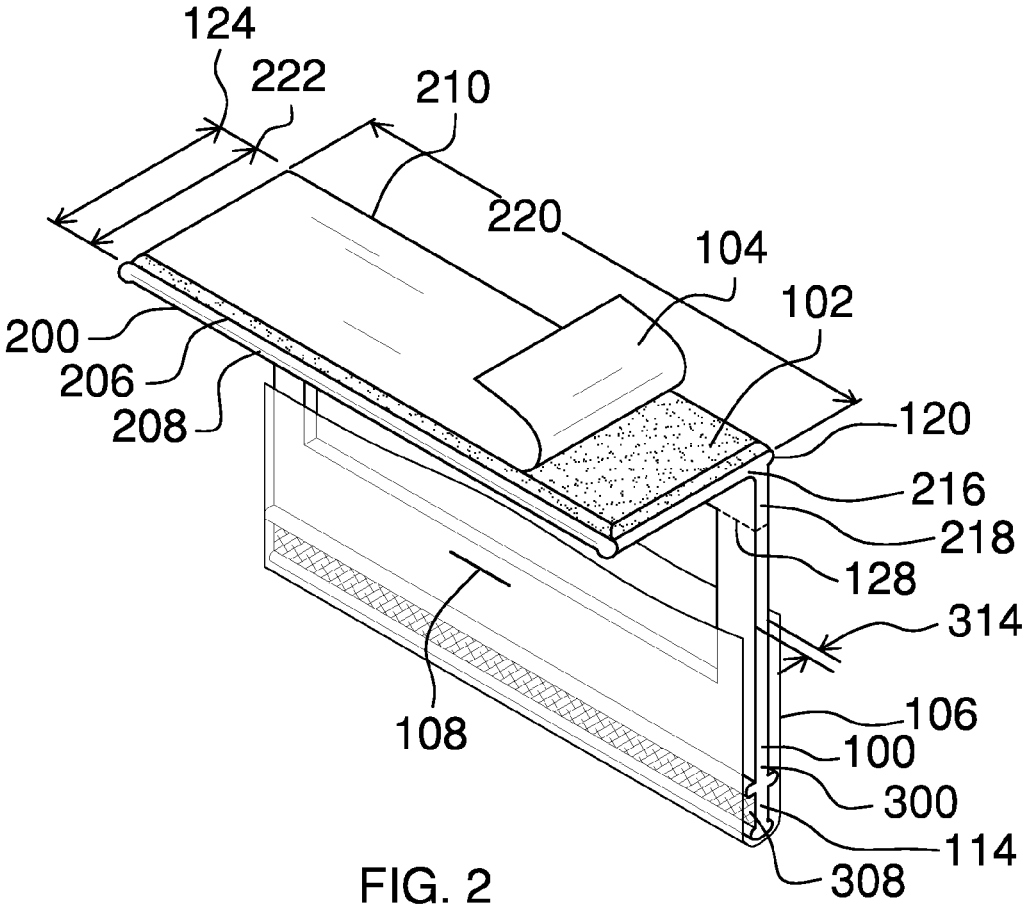
FIG. 2 is an isometric view of marker 100 in an upside down position.

FIG. 1 is an isometric view of marker 100. FIG. 2 is an isometric view of marker 100 in an upside down position.

Marker 100 may be a temporary pavement marker for pavement surface treatment. Pavement may be a durable surface material laid down on an area intended to sustain traffic, such as automobile and foot traffic. Pavement surface treatment processes may include any treatment that may cover pavement surface markings, such as slurry sealing, chip sealing, and sand sealing. Marker 100 may aid in replacing the existing pavement surface markings with new pavement surface markings. For example, multiple markers 100 may be placed on pavement prior to a pavement surface treatment process to identify existing lines, symbols, words, and other pavement surface markings through the surface treatment process. After the existing surface markings are covered by the pavement surface treatment, new pavement surface markings then may be installed based on the identifications made by markers 100. Here, markers 100 may allow striping to be put back into its original location.

Marker 100 may include adhesive 102, a release paper 104, a reflector cover 106, a fastener 108, a base 200, and upright section 300. Adhesive 102 may be positioned between release paper 104 and base 102. Reflector cover 106 may be rapped around upright section 300 and secured to upright section 300 by fastener 108. Upright section 300 may be attached to base 200.

Figure 3:
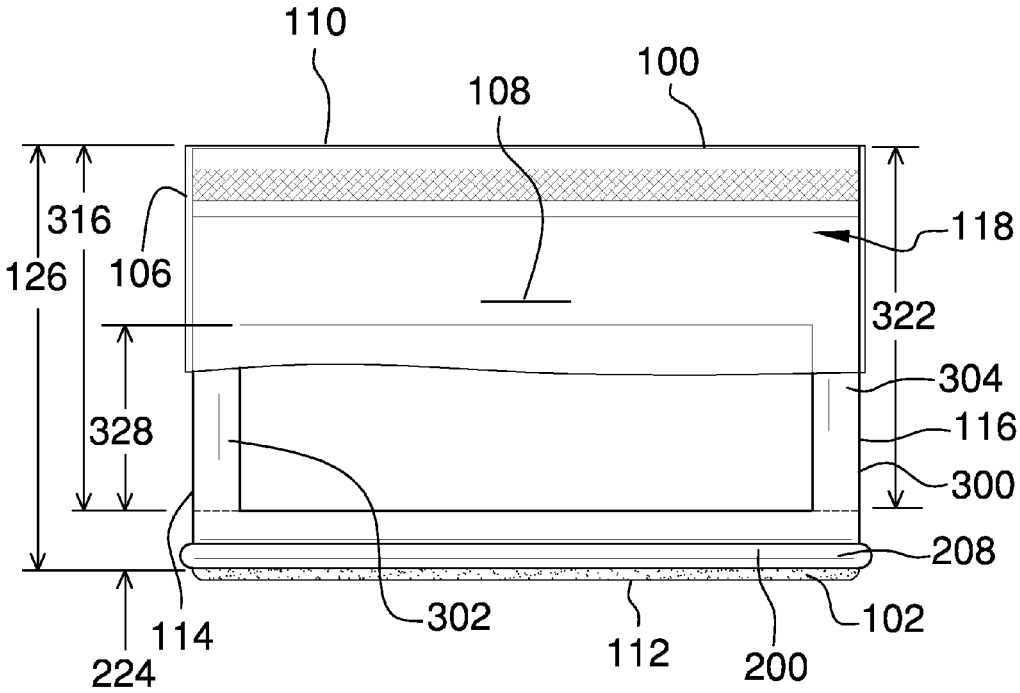
FIG. 3 is a front view of marker 100 with release paper 104 removed.

FIG. 3 is a front view of marker 100 with release paper 104 removed. Typically, marker 100 may be installed onto a road surface with release paper 104 removed to expose adhesive 102 and reflector cover 106 in place to protect a reflector 308 from being covered by surface treatment. When release paper 104 is removed from marker 100 as in FIG. 3, marker 100 may define a marker top 110 and a marker bottom 112 positioned between a marker left side 114, a marker right side 116, a marker front 118, and a marker rear 120 (FIG. 1). Marker top 110 may be an uppermost surface of marker 100 and marker bottom 112 may be a lowermost surface of marker 100.

Location terms such as top, bottom, left, right, front, and rear may be relative to an orientation of marker 100. For example, left may be right and front may be rear. These directional terms are provided to describe the principles and should not be construed as limiting the scope of the subject matter of the terms of the claims.

During resurfacing operations of a roadway, multiple layers of surface coating may be applied over marker 100 in a direction of the traffic flow of the roadway. Marker left side 114 and marker right side 116 may be those outermost surfaces of marker 100 likely to be positioned parallel to a direction in which the surface coating is applied. Marker front 118 and marker rear 120 may be those outermost surfaces of marker 100 likely to be positioned perpendicular to (facing) a direction in which the surface coating is applied. Marker front 118 and marker rear 120 each may include portions of plastic cover 106 and upright section 300. Marker front 118 and marker rear 120 may receive a brunt of the surface coating application. During surface treatment, plastic cover 106 may protect an upper portion of upright section 300 from surface treatment 12. After surface treatment 12 is applied, plastic cover 106 may be removed, which sometimes may remove fastener 108.

Figure 4:
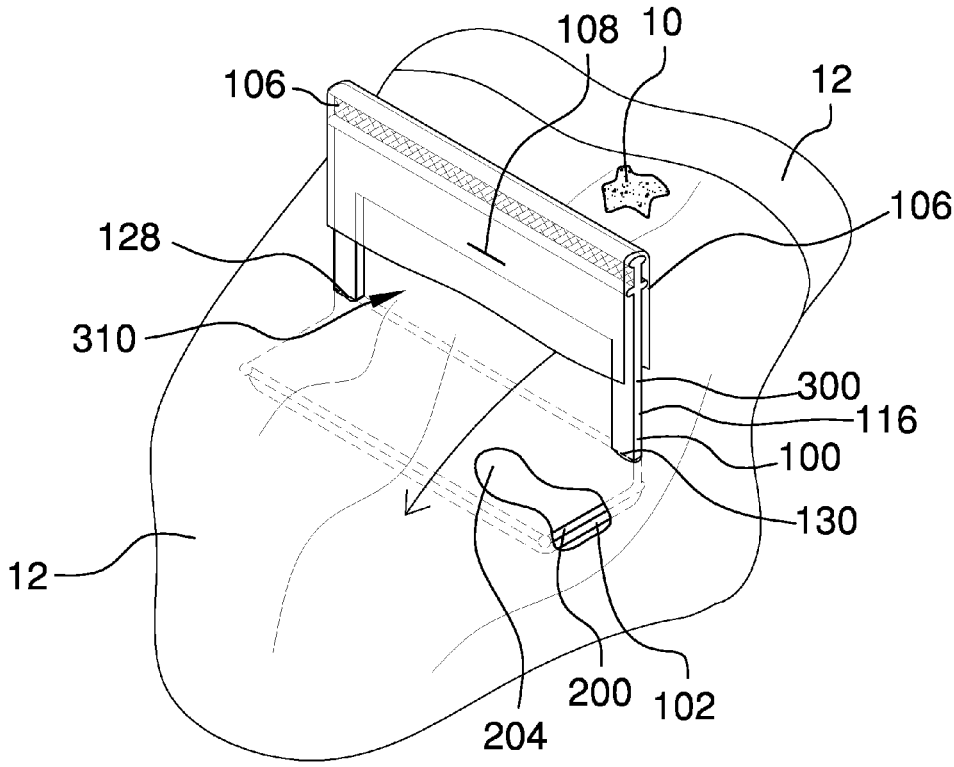
FIG. 4 is an isometric view of marker 100 adhered to a pavement 10 with treatment 10 residing within treatment passageway 310 over base 200.
Figure 5:
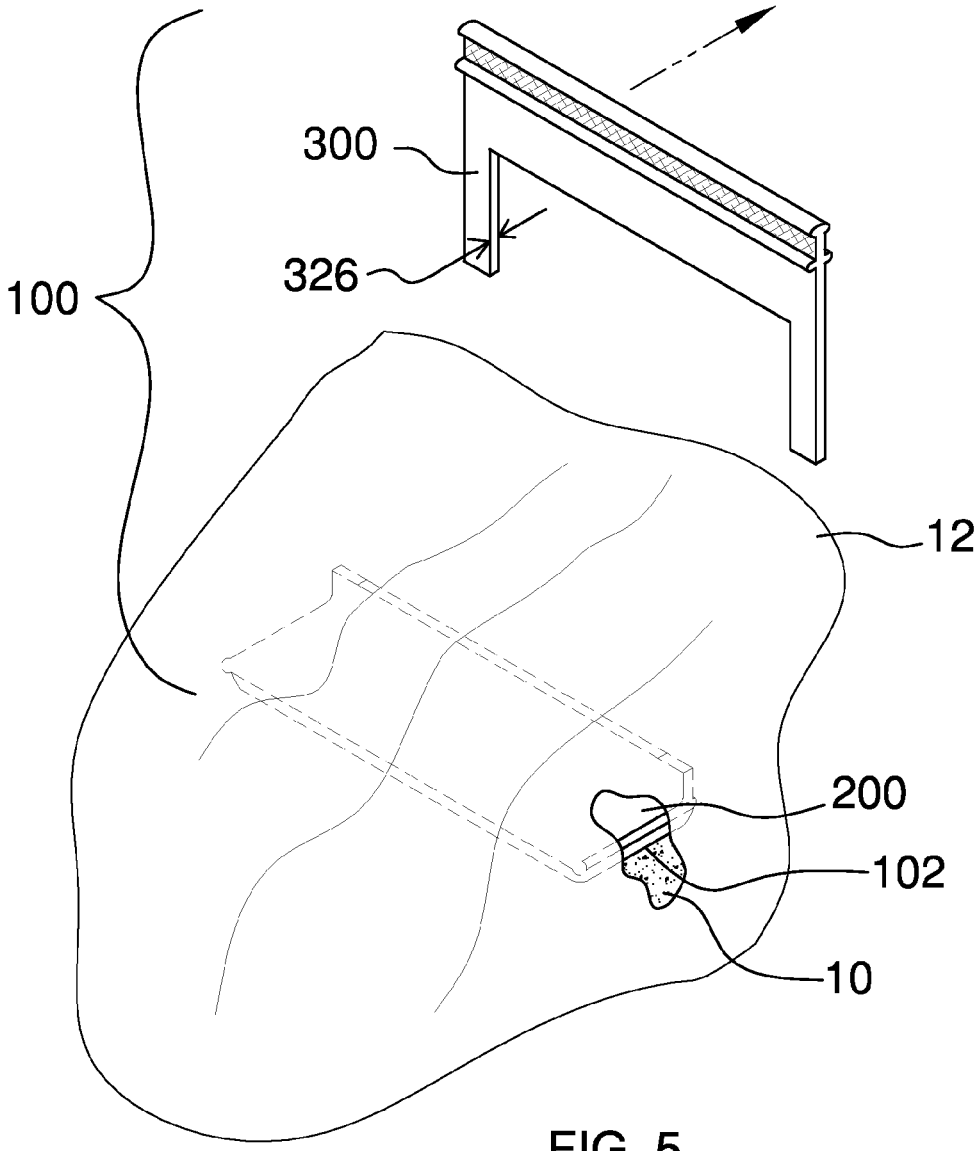
FIG. 5 is an isometric view of marker 100 with upright section 300 separated from base 200 and adhesive 102.

FIG. 4 is an isometric view of marker 100 adhered to a pavement 10 with treatment 10 residing within treatment passageway 310 over base 200. During a pavement surface treatment process, adhesive 102 may be used to secure base 200 to pavement 10. Most of base 200 may be covered by surface treatment 12 and most of upright section 300 may rise above surface treatment 12 (FIG. 4). In regards to being temporary, marker 100 may remain in place until the earliest date when it is practical and possible to install pavement markings that may meet a location standard for pavement markings. After a need to identify existing pavement surface markings has ended, upright section 300 may be removed from pavement 10 and base 200 may remain underneath pavement surface treatment 12 (FIG. 5). Over time, surface treatment 12 may flow to cover any remaining uncovered portion of base 200.

Marker 100 may be utilized as traffic control zone device and in pavement surface treatment and may be classified into four types as in TABLE 1:

TABLE 1

| CLASSIFICATION | DESCRIPTION |
|---|---|
| Type 1 | Marker may be acceptable for use on all roadways for short or long-term projects and may supplement or simulate solid or broken lines. |
| Type 2 | Marker may be acceptable for use on projects with less than 3,000 Average Daily Traffic and may supplement or simulate solid or broken lines. |
| Type 3 | Marker may be acceptable for use on all roadways for short or long-term projects and may supplement solid or broken lines, but not simulate solid or broken lines. |
| Type 4 | Marker may be acceptable for use on pavement sealing operations, such as slurry sealing, chip sealing, or sand sealing and may be configured to be placed prior to the sealing operation with a protective cover that may be removed after the seal coat is applied. |

Adhesive 102 may be a substance that may bond base 200 and pavement together. Adhesive 102 may include bituminous pavement marker adhesive manufactured by Valero Marketing & Supply Company of San Antonio, Tex., for example. Release paper 104 may be a backing paper for self-adhesives. Release paper 104 may be removed to expose adhesive 102 for bonding marker 100 to a pavement.

Reflector cover 106 may be a removable, clear covering to protect upright section 300 from surface treatment 12. Reflector cover 106 may be a releasable mask position over reflector 308. During pavement resurfacing, marker 100 may be repeatedly doused with pavement surface treatment. Reflector cover 106 may keep a reflector 308 clean and free of treatment. Once pavement 10 has been resurfaced, reflector cover 106 may be removed from reflector 308 to expose a clean reflector 308 to light. In one example, reflector cover 106 may be a thin clear plastic film with a reflector cover tab to aid in removing reflector cover 106 from upright section 300. In another example, reflector cover 106 may include reflective properties.

Fastener 108 may be a device to secure reflector cover 106 to upright section 200. In an example, fastener 108 may be a short U-shaped wire nail to be passed through reflector cover 106 and upright section 300. In another example, fastener 108 may be a product that results when a portion of reflector cover 106 and upright section 300 are pinched together and heated. In a further example, fastener 108 may be a strip of adhesive secured between reflector cover 106 and upright section 300.

Marker 100 may include an overall marker length 122 (FIG. 1) as measured between marker left side 114 and marker right side 116, an overall marker width 124 (FIG. 2), and an overall marker height 126 (FIG. 3) as measured between marker top 110 and marker bottom 112. In one example, overall marker length 122 approximately may be four inches, overall marker width 124 approximately may be one-eighth inch to one and one-eighth inches, and overall marker height 126 approximately may be two inches. Marker 100 may include a white color that may conform to color number 17778 of the Federal Standard Number 5952 for daytime visibility. Marker 100 may include a yellow color that may conform to the Federal Highway Administration's Yellow Color Tolerance Chart for daytime visibility. Marker 100 may be resilient and include material such as polyurethane and other flexible plastic.

Base 200 may be a lower support for marker 100. Base 200 may be configured to be covered by treatment and remain fixedly under pavement surface treatment 12. Base 200 (FIG. 1) may include a base adjoin top 202, a base support top 204, and a base bottom 206 positioned between a base front 208, a base rear 210, a base left side 212, and a base right side 214. Base 200 may include a base horizontal section 216 connected to a base vertical section 218. Base adjoin top 202 may be an upper surface of base vertical section 218 and base support top 204 may be an upper surface of base horizontal section 216.

Base 200 generally may have a rectangular shape and may have a base length 220 (FIG. 2), a base width 222 (FIG. 2), and a base height 224 (FIG. 3). Base length 220 may be measured in a traverse direction between base left side 212 and base right side 214. Base width 222 may be measured in a longitudinal direction between base front 208 and base rear 210. Base height 224 may be measured in a vertical direction from base bottom 206 to base adjoin top 202. In one example, base length 220 approximately may be four inches, base width 222 approximately may be one and one-eighth inches, and base height 224 approximately may be 0.06 inch. In another example, base height 224 approximately may be 0.25 inch. One or both of base adjoin top 202 and base support top 204 may include contours.

Upright section 300 may be that portion of marker 100 to be vertically orientated once marker 100 is adhered to pavement 10. Upright section 300 may extend up and away from base 200 substantially to remain out of surface treatment 12. Upright section 300 may include a first upright 302, a second upright 304, a bridge 306, and a reflector 308. First upright 302 may be attached to base 200 near marker left side 114 and second upright 304 may be attached to base 200 near marker right side 116. Bridge 306 may be remote from base 200 and attached between first upright 302 and second upright 304 to form a treatment passageway 310 with first upright 302, second upright 304, and base vertical section 218 of base 200. Reflector 308 may be attached to upright section 300 along bridge 306.

First upright 302 may be a vertical structural member. First upright 302 may have a first upright length 312 (FIG. 1), a first upright width 314 (FIG. 2), and a first upright height 316 (FIG. 3). Second upright 304 may be a vertical structural member. Second upright 304 may have a second upright length 318 (FIG. 1), a second upright width 320, and a second upright height 322 (FIG. 3). In one example, first upright length 312 and second upright length 318 each substantially may be ⅜-inch. In an example, first upright width 314 and second upright width 320 each substantially may be 0.06 inch and may be positioned adjacent to one of base front 208, base rear 210, and a midpoint between base front 208 and base rear 210. In another example, first upright width 314 and second upright width 320 each substantially may equal base width 222.

In an example, at least one of first upright length 312, first upright width 314, and first upright height 316 may be different from second upright length 318, second upright width 320, and second upright height 322, respectively. First upright 302 may have a variety of geometric cross sections, such as a rectangle, circle, hexagon, and star, and be solid or hollow.

Bridge 306 may be a horizontal structural member to support reflector 308 above and away from base 200. Bridge 306 may span between first upright 302 and second upright 304. Uprights in addition to first upright 302 and second upright 304 may be added to support bridge 306 above base 200.

Reflector 308 may redirect the light flow from a source by bouncing it off a surface of reflector 308. Reflector 308 may be attached to upright section 300 and reside on at least one of marker top 110, marker front 118, marker rear 120, marker left side 114, and marker right side 116. Reflector 308 may contain a retroreflective surface to send light back where it came from regardless of an angle of incidence. For example, reflector 308 may send automobile light back to the automobile to let a nighttime driver know of the existence and position of marker 100.

Treatment passageway 310 may be an opening in marker 100 that may pass from marker front 118 to marker rear 120. Treatment passageway 310 may be a path, channel, or duct through which treatment may pass to cover that portion of base 200 exposed to treatment passageway 310. FIG. 4 is an isometric view of marker 100 adhered to a pavement 10 with treatment 12 residing within treatment passageway 310 and over base 200. Preferably, treatment 12 may include slurry sealing, but treatment 12 may include chip sealing, sand sealing, and any treatment that may cover pavement surface markings.

Treatment passageway 310 may have a treatment passageway length 324 (FIG. 1), a treatment passageway width 326 (FIG. 5), and a treatment passageway height 328 (FIG. 3). In an example, treatment passageway length 324 approximately may be sixty to eighty percent of base length 220. Treatment passageway height 328 may be sixty to eighty percent of overall marker height 126. In one example, treatment passageway height 328 approximately may be equal to a height of treatment 10 residing within treatment passageway 310.

Treatment passageway 310 may be continuous along treatment passageway length 324. In an example, treatment passageway 310 may be discontinuous along treatment passageway length 324. For example, rather than a rectangular shaped passageway, treatment passageway 310 may include a series of holes adjacent base 200, where the holes may permit treatment 10 to pass from marker front 118, through treatment passageway 310, to marker rear 120.

FIG. 5 is an isometric view of marker 100 with upright section 300 separated from base 200 and adhesive 102. As noted above, upright section 300 may be removed from the pavement and base 200 may remain underneath pavement surface treatment 12. Preferably, base 200 and upright section 300 may be separated where base 200 and upright section 300 meet. To aid in this separation, a connection between base 200 and upright section 300 may be weakened. In an example, marker 100 may include a first perforation 128 (FIG. 2) between first upright 302 and base 200 and a second perforation 130 (FIG. 1) between second upright 304 and base 200. First perforation 128 may be series of small incisions, holes, or cuts made along a predetermined path to facilitate separating first upright 302 from base 200.

Adding treatment passageway 310 to marker 100 may weaken a connection between base 200 and upright section 300. Perforations may be added between a connection between base 200 and upright section 300 to weaken a connection between base 200 and upright section 300. In another example, a connection between base 200 and upright section 300 may be thinned to provide a weakened connection. A thinned location where base 200 and upright section 300 meet may included a cross section that may be smaller in the thinned location in comparison with a cross section elsewhere along first upright 302. At least one of first upright length 312 and first upright width 314 may be smaller at the joint than elsewhere along first upright 302 to assist in the separation of upright section 300 from base 200.

Figure 6:
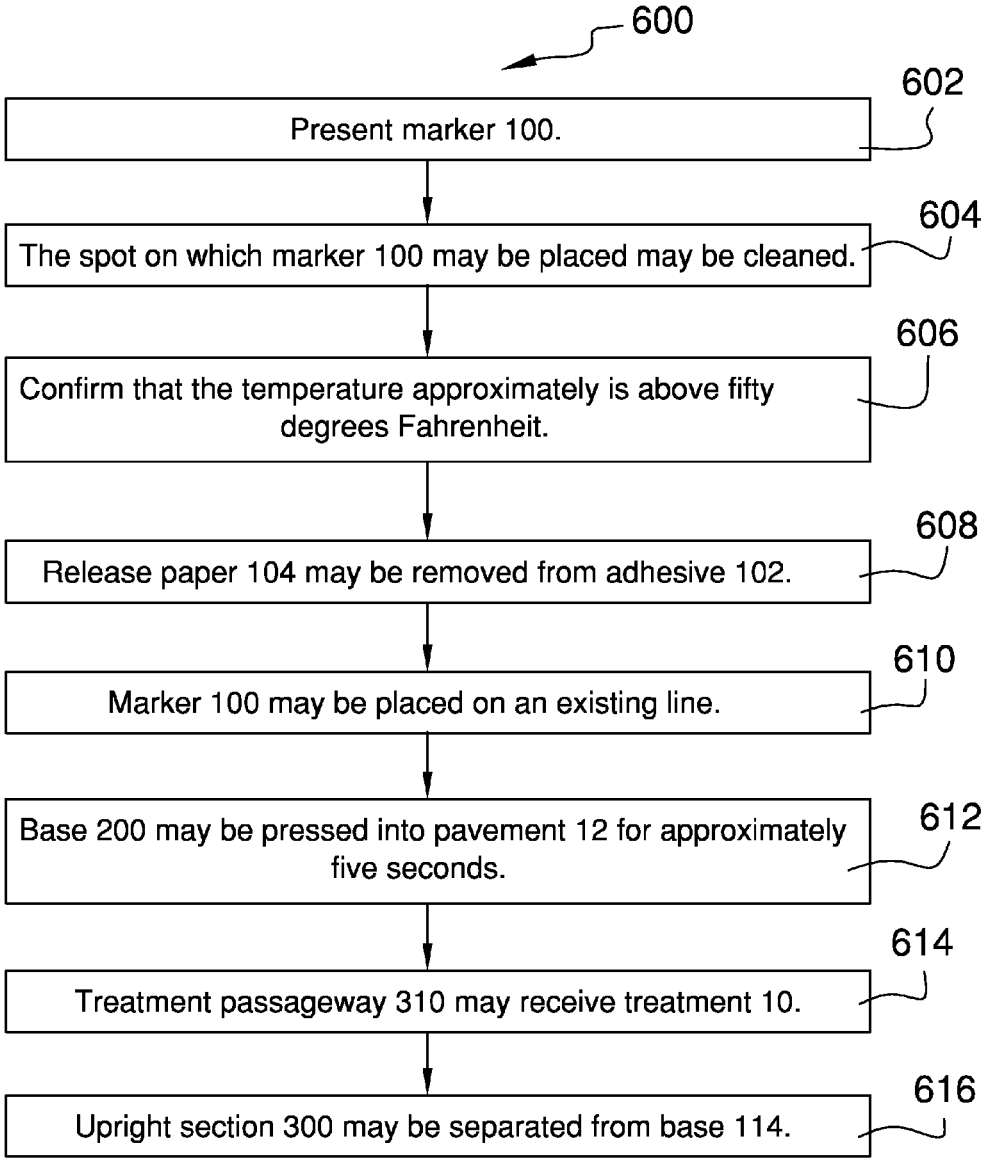
FIG. 6 is a method 600 to utilize marker 100 in treatment 10 on pavement 10.

FIG. 6 is a method 600 to utilize marker 100 in treatment 10 on pavement 10. At 602, method 600 may present marker 100. At 604, the spot on which marker 100 may be placed may be cleaned. Pavement 10 may be swept, brushed, cleaned with a rag or compressed air. Preferably, the spot may be free of dust, dirt, oil, and moisture. At 606, method 600 may confirm that the temperature approximately is above fifty degrees Fahrenheit. At below fifty degrees Fahrenheit, atmospheric moisture may inhibit adhesion of marker 100 to pavement 10. If the temperature approximately is below fifty degrees Fahrenheit, then a pavement primer may be used on the pavement.

At 608, release paper 104 may be removed from adhesive 102. At 610, marker 100 may be placed on an existing line. Preferably, marker 100 may be position so that treatment passageway 310 may face the direction in which treatment 10 is to be applied. At 612, base 200 may be pressed into pavement 10 for approximately five seconds. At 614, treatment passageway 310 may receive treatment 10. For example, slurry sealing may be passed through treatment passageway 310. When upright section 300 no longer is needed, upright section 300 may be separated from base 200. At 616, upright section 300 may be separated from base 200. Alternatively, upright section 300 may remain fixed to base 200 so that marker 100 may be utilized as a type-1, type-2, and/or type-3 traffic control zone device.

The temporary pavement marker may be a temporary marker for road surface markings that may be use in slurry seal applications. The temporary pavement marker may substitute for pavement markings. The temporary pavement marker may be made of flexible plastic and may measure four inches wide by two inches high by one-eight inch thick. The temporary pavement marker may include a lower flange that may be coated with a pressure-sensitive adhesive. The temporary pavement marker may include white and yellow and may feature a reflective coating on its upper portion. The temporary pavement marker may include a large opening in its upright portion that may limit the effect the temporary pavement marker has on the flow of slurry upon a roadway. The joint between its base and upright portion may feature perforations or a thinned area that may permit the upright portion to be torn or cut off the base once striping is applied to the roadway. Under U.S. Federal Highway Administration Manual on Uniform Traffic Control Devices section 3B.14 and section 6F.72, marker 100 may remain in place until the earliest date when it may be practical and possible to install pavement markings that may meet the Part 3 standard for pavement markings. As an example, marker 100 should not be in place for more than two weeks (fourteen days) unless justified by an engineering study.

The temporary pavement marker may aid slurry seal application projects. Appealing features of the temporary pavement marker may be its ease of installation and removal and ability to minimize void creation in a slurry seal coat. The temporary pavement marker openwork may prevent the temporary pavement marker from creating a bare spot or void in a slurry seal coating, thereby increasing the overall integrity and durability of the slurry seal coating. Similarly, since it may be removed with its base remaining in place, it may not damage a coating of this nature.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A temporary pavement marker for pavement surface treatment of existing pavement, the temporary pavement marker comprising:

a base configured to be placed against the existing pavement; and an upright section connected to the base, where the upright section includes a bridge connected between a first upright and a second upright to form a treatment passageway, where the bridge, the first upright, the second upright, and the base are positioned around the treatment passageway whereby the treatment passageway permits pavement treatment material to cover and surround the base of the temporary marker.

2. The temporary pavement marker of claim 1, where the base includes a base length and the treatment passageway includes treatment passageway length that approximately is sixty to eighty percent of the base length.

3. The temporary pavement marker of claim 1, where the treatment passageway is a horizontally elongated opening through the upright section that passes from an upright section front to an upright section rear to receive treatment there-through to cover that portion of the base horizontally positioned directly between the first upright and the second upright and vertically positioned directly below the bridge and within the treatment passageway.

4. The temporary pavement marker of claim 3, where a treatment passageway height of the treatment passageway as measured vertically between the base and the bridge is at least sixty percent of an overall marker height of the marker.

5. The temporary pavement marker of claim 3, where perforations reside between the base and the first upright, and where perforations reside between the base and the second upright.

6. The temporary pavement marker of claim 3, further comprising:

a reflector attached to the upright section above and remote from the treatment passageway, where a treatment passageway height of the treatment passageway as measured between the base and the bridge is at least sixty percent of a base length of the base, and where a width of the treatment passage way is equal to a width of the first upright, the second upright, and a lower portion of the bridge.

7. The temporary pavement marker of claim 3, where at least one of a first upright length and a first upright width is smaller at a location where the base and the upright section meet than elsewhere along the first upright.

8. The temporary pavement marker of claim 1, further comprising:

at least one of adhesive positioned between a release paper and a marker bottom the base, and a reflector, where the reflector resides on at least one of a marker top, a marker front, a marker rear, a marker left side, and a marker right side and a reflector cover positioned over the reflector, where the reflector cover includes a thin clear plastic film with a reflector cover tab.

9. A temporary pavement marker for pavement surface treatment of existing pavement, the temporary pavement marker comprising:

a base configured to be placed against the existing pavement;

an upright section connected to the base, where the upright section includes a first upright, a second upright, a treatment passageway, and a bridge, where the first upright and the second upright are vertically orientated and separated horizontally from each other by the treatment passageway, where the base is in direct contact with the first upright, the second upright, and the treatment passageway, where the bridge is in direct contact with the first upright, the second upright, and the treatment passageway, and where the bridge is separated vertically from the base by the treatment passageway to form a horizontally elongated opening through the upright section whereby the treatment passageway permits pavement treatment material to cover and surround the base of the temporary marker.

10. The temporary pavement marker of claim 9, where a treatment passageway height of the treatment passageway as measured vertically between the base and the bridge is at least sixty percent of an overall marker height of the marker.

11. The temporary pavement marker of claim 9, where the base includes a base length and the treatment passageway includes treatment passageway length that approximately is sixty to eighty percent of the base length.

12. The temporary pavement marker of claim 9, where a treatment passageway height of the treatment passageway as measured vertically between the base and the bridge is sixty to eighty percent of an overall marker height of the marker.

13. The temporary pavement marker of claim 9, where perforations reside between the base and the first upright, and where perforations reside between the base and the second upright.

14. The temporary pavement marker of claim 9, further comprising:

a reflector attached to the upright section above and remote from the treatment passageway, where a treatment passageway height of the treatment passageway as measured between the base and the bridge is at least sixty percent of a base length of the base, and where a width of the treatment passage way is equal to a width of the first upright, the second upright, and a lower portion of the bridge.

15. The temporary pavement marker of claim 9, where at least one of a first upright length and a first upright width is smaller at a location where the base and the upright section meet than elsewhere along the first upright.

16. The temporary pavement marker of claim 9, further comprising:

at least one of adhesive positioned between a release paper and a marker bottom the base, and a reflector, where the reflector resides on at least one of a marker top, a marker front, a marker rear, a marker left side, and a marker right side and a reflector cover positioned over the reflector, where the reflector cover includes a thin clear plastic film with a reflector cover tab.

17. A method to utilize a temporary pavement marker during treatment of an existing pavement, the method comprising:

presenting a temporary pavement marker having a base configured to be placed against the existing pavement and an upright section connected to the base, where the upright section includes a bridge connected between a first upright and a second upright to form a treatment passageway, where the bridge, the first upright, the second upright, and the base are positioned around the treatment passageway;

placing the base against the pavement; and receiving treatment through the treatment passageway whereby receiving treatment through said passageway facilitates covering the base with said treatment material.

18. The method of claim 17, further comprising:

separating the upright section from the base.

19. The method of claim 17, where separating the upright section from the base includes separating the second upright section from the base after separating the first upright section from the base.

20. The method of claim 17, where the treatment passageway is a horizontally elongated opening through the upright section that passes from an upright section front to an upright section rear, where perforations reside between the base and the first upright, where perforations reside between the base and the second upright, and where a reflector attached to the upright section above and remote from the treatment passageway.

* * * * *